US009737109B2

(12) United States Patent
Johnson

(10) Patent No.: US 9,737,109 B2
(45) Date of Patent: Aug. 22, 2017

(54) FOOTWEAR WITH REMOVABLE MIDSOLE AND OUTSOLE

(71) Applicant: Nike, Inc., Beaverton, OR (US)

(72) Inventor: Jeffrey L. Johnson, Taichung (TW)

(73) Assignee: Nike, Inc., Beaverton, OR (US)

( * ) Notice: Subject to any disclaimer, the term of this patent is extended or adjusted under 35 U.S.C. 154(b) by 12 days.

(21) Appl. No.: 14/706,466

(22) Filed: May 7, 2015

(65) Prior Publication Data

US 2016/0324264 A1 Nov. 10, 2016

(51) Int. Cl.

| | |
|---|---|
| ***A43B 3/24*** | (2006.01) |
| ***A43B 13/12*** | (2006.01) |
| ***A43B 13/36*** | (2006.01) |
| ***A43B 23/02*** | (2006.01) |
| ***A43B 9/00*** | (2006.01) |
| ***A43B 17/18*** | (2006.01) |

(52) U.S. Cl.

CPC ..... *A43B 3/244* (2013.01); *A43B 3/246* (2013.01); *A43B 9/00* (2013.01); *A43B 13/12* (2013.01); *A43B 13/36* (2013.01); *A43B 17/18* (2013.01); *A43B 23/0245* (2013.01)

(58) Field of Classification Search

CPC ..... A43B 3/24; A43B 3/244; A43B 3/246; A43B 13/12; A43B 13/36

USPC ..... 36/15, 100, 101

See application file for complete search history.

(56) References Cited

U.S. PATENT DOCUMENTS

| | | | | |
|---|---|---|---|---|
| 2,438,711 A | | 3/1948 | Leach et al. | |
| 2,552,943 A | | 5/1951 | Danielius | |
| 3,846,919 A | | 11/1974 | Milotic | |
| 3,878,626 A | | 4/1975 | Isman | |
| 3,983,642 A | | 10/1976 | Liao | |
| 4,062,132 A | * | 12/1977 | Klimaszewski | A43B 13/36 36/100 |
| 4,103,440 A | | 8/1978 | Lawrence | |
| 4,267,649 A | | 5/1981 | Smith | |
| 4,317,294 A | * | 3/1982 | Goodyear | A43B 13/36 36/100 |
| 4,377,042 A | | 3/1983 | Bauer | |
| 4,420,894 A | | 12/1983 | Glassman | |
| 4,706,392 A | | 11/1987 | Yang | |
| 4,839,948 A | | 6/1989 | Boros | |
| 4,974,344 A | | 12/1990 | Ching | |
| 5,065,531 A | | 11/1991 | Prestridge | |
| 5,083,385 A | | 1/1992 | Halford | |

(Continued)

FOREIGN PATENT DOCUMENTS

| | | |
|---|---|---|
| EP | 0153136 A2 | 8/1985 |
| WO | 02071880 A1 | 9/2002 |

(Continued)

*Primary Examiner* — Sharon M Prange

(74) *Attorney, Agent, or Firm* — Shook, Hardy & Bacon L.L.P.

(57) ABSTRACT

An article of footwear having a removable outsole, midsole, and upper is provided. A portion of the upper may have a perimeter lip that may be coupled to a perimeter channel in an upper surface or side of the outsole. The midsole may be securely placed into the upper to further secure the upper to the outsole. The fit of the outsole, upper, and midsole generates a securely assembled article of footwear ready for user wear. In aspects, the removable outsole, midsole, and upper may be changed to customize the article footwear for the user.

8 Claims, 12 Drawing Sheets

(56) References Cited

U.S. PATENT DOCUMENTS

| | | | | |
|---|---|---|---|---|
| 5,381,610 | A | 1/1995 | Hanson | |
| 5,983,528 | A | 11/1999 | Hartung | |
| 6,023,857 | A | 2/2000 | Vizy et al. | |
| 6,023,859 | A | 2/2000 | Burke et al. | |
| 6,931,766 | B2 | 8/2005 | Greene | |
| 7,076,890 | B2 * | 7/2006 | Grove | A43B 13/223 36/100 |
| 7,140,129 | B2 | 11/2006 | Newson et al. | |
| 7,174,657 | B2 | 2/2007 | Berg et al. | |
| 7,246,453 | B2 * | 7/2007 | Kim | A43B 5/00 36/100 |
| 7,451,557 | B2 | 11/2008 | McDonald et al. | |
| 7,520,069 | B2 | 4/2009 | Workman et al. | |
| 8,104,196 | B2 | 1/2012 | Spinelli | |
| 8,220,184 | B2 | 7/2012 | Albert | |
| 8,240,067 | B2 * | 8/2012 | Sussmann | A43B 3/24 36/103 |
| 8,307,570 | B2 | 11/2012 | Delgatty | |
| 8,307,571 | B1 * | 11/2012 | Ceylan | A43B 3/246 36/101 |
| 8,356,426 | B1 | 1/2013 | Daniel et al. | |
| 8,544,189 | B2 | 10/2013 | Chaney et al. | |
| 8,567,098 | B2 | 10/2013 | Hsu | |
| 9,408,434 | B2 * | 8/2016 | Su | A43B 5/08 |
| 2008/0098623 | A1 * | 5/2008 | Komitau | A43B 3/244 36/101 |
| 2008/0172904 | A1 | 7/2008 | Pelsue et al. | |
| 2010/0115794 | A1 | 5/2010 | Gillett | |
| 2013/0139408 | A1 | 6/2013 | Chaiken | |
| 2014/0259779 | A1 * | 9/2014 | Hashish | A43B 3/244 36/100 |

FOREIGN PATENT DOCUMENTS

| | | | |
|---|---|---|---|
| WO | 2004103105 | A1 | 12/2004 |
| WO | 2010093271 | A1 | 8/2010 |

* cited by examiner

FOOTWEAR WITH REMOVABLE MIDSOLE AND OUTSOLE

CROSS-REFERENCE TO RELATED APPLICATIONS

Non-applicable.

TECHNICAL FIELD

The present disclosure relates to an article of footwear having removable components. More particularly, the present disclosure relates to an article of footwear having a removable midsole and outsole that include interlocking properties.

BACKGROUND

In order to assemble an article of footwear, generally an adhesive and/or stitching is utilized to permanently secure footwear components, such as an outsole, midsole, and upper, to one another. Generally, adhesives and stitching are required to create a lasting bond between the footwear components that withstands use and wear. As such, the components of the shoe may not be changed or replaced without significantly damaging the outsole, midsole, and upper such that a user must replace the entire article of footwear or purchase several different types or styles of footwear based on the user's preferences and/or requirements. Accordingly, there is a need for footwear having a removable outsole, midsole, and upper that may be readily assembled and disassembled to customize the article of footwear without the use of adhesives or stitching.

BRIEF SUMMARY

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. The present invention is defined by the claims.

At a high level, exemplary aspects herein include an article of footwear having removable upper, midsole, and outsole components. The components are configured to work cooperatively with one another, and include mechanical locking and/or slip fit elements which remove the need for adhesives and/or stitching in assembling the article of footwear. In exemplary aspects, a removable upper fits with a removable outsole such that each is secured together without requiring the use of adhesives or stitching to assemble the article of footwear. In further exemplary aspects, the insertion and/or placement of a removable midsole into the removable upper further secures the outsole to the upper.

BRIEF DESCRIPTION OF THE DRAWINGS

The present invention is described in detail herein with reference to the attached drawing figures, wherein.

DETAILED DESCRIPTION

Figure 1:
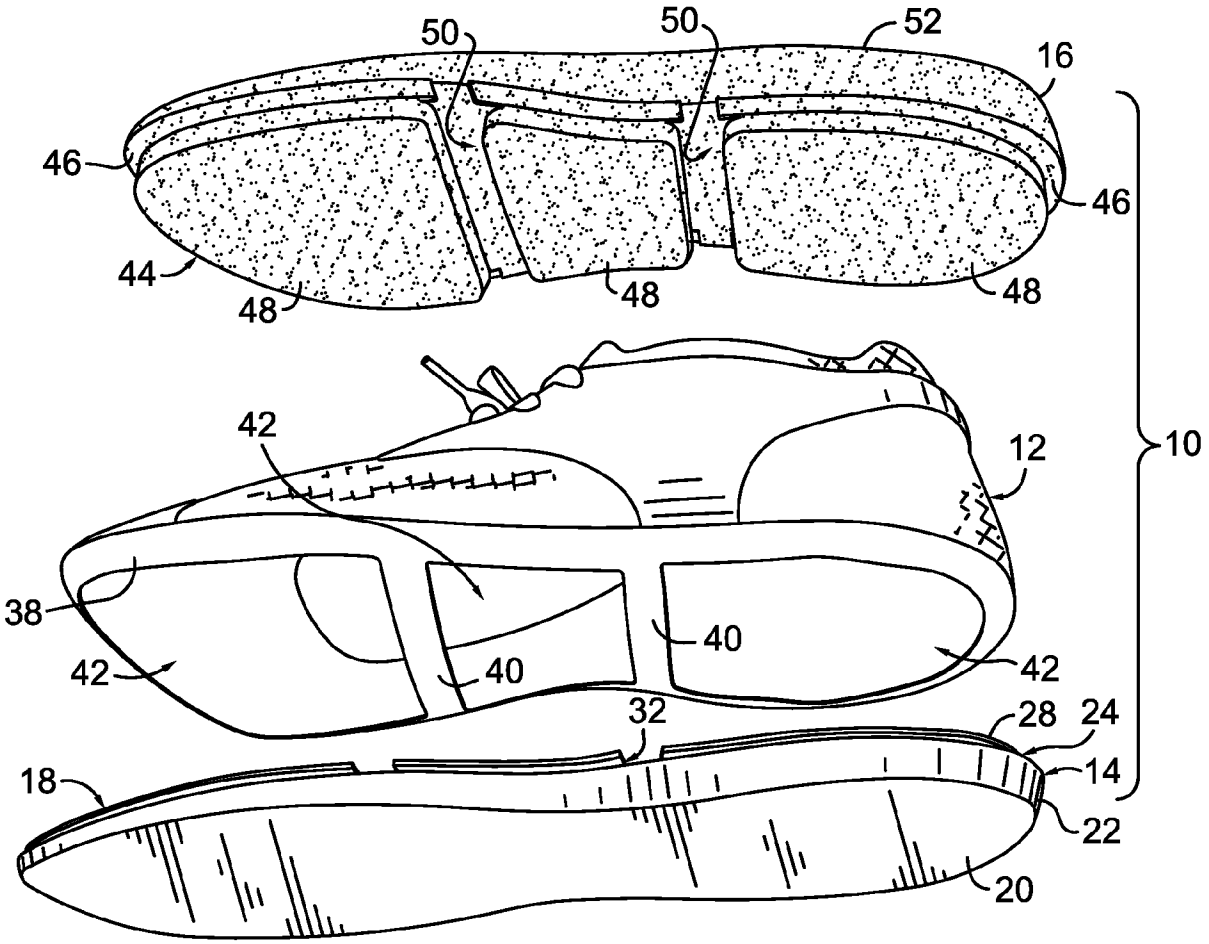
FIG. 1 depicts a lateral perspective view of the unassembled components of an exemplary article of footwear for reference purposes in accordance with an aspect hereof.

Aspects hereof provide an article of footwear, or a shoe, that may be modular in nature. At a high level, as shown in FIG. 1, the footwear 10 may comprise removable components such as a removable upper 12, outsole 14, and midsole 16. These components are configured to fit together to form an assembled article of footwear 10 (FIG. 5) that obviates the need for additional stitching or adhesives to secure the components relative to one another. Exemplary articles of footwear 10 may include athletic shoes, dress shoes, boots, loafers, and the like. The term "footwear" and/or "shoe" may be used herein for simplicity, in reference to various examples of the articles of footwear. However, concepts described herein may be applied to a variety of other types of footwear.

The exemplary outsole 14 depicted in FIG. 1 generally comprises the layer or layers of footwear 10 made for directly contacting the ground or other surface. Casual or athletic footwear usually has outsoles made from natural rubber, a plastic, or a synthetic material, such as polyurethane. The outsole 14 may comprise a single piece of material or may be an assembly of separate pieces of different materials. Additionally, the outsole 14 may comprise different fixtures for various purposes, such as cleats and/or spikes for traction. In particular, tread may be formed on the outsole in patterns to maximize gripping or traction. For example, the tread of the outsole 14 may comprise portions in circular, triangular, rectangular, pentagonal, hexagonal, octagonal, or other types of patterns. In further aspects, the outsole 14 and/or tread might have permanent, or alternatively non-permanent, interchangeable features (e.g., cleats, spikes, and perforations for foot plates).

Figure 1A:
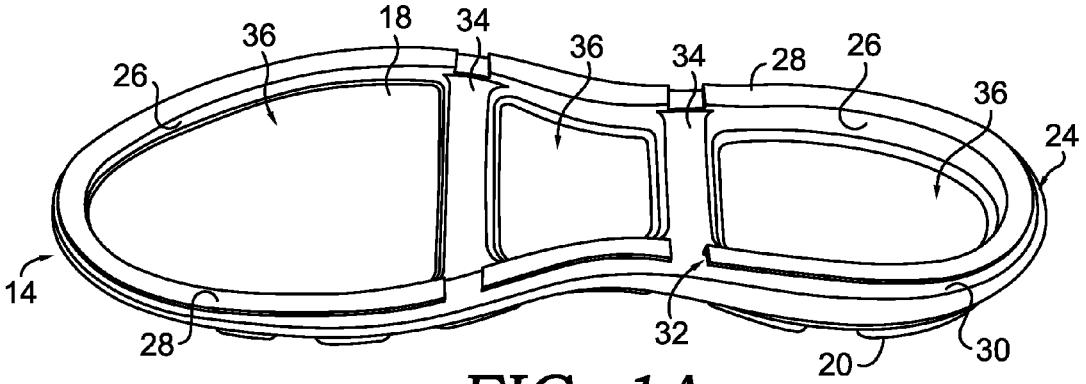
FIG. 1A is a top view of the outsole of FIG. 1.
Figure 7:
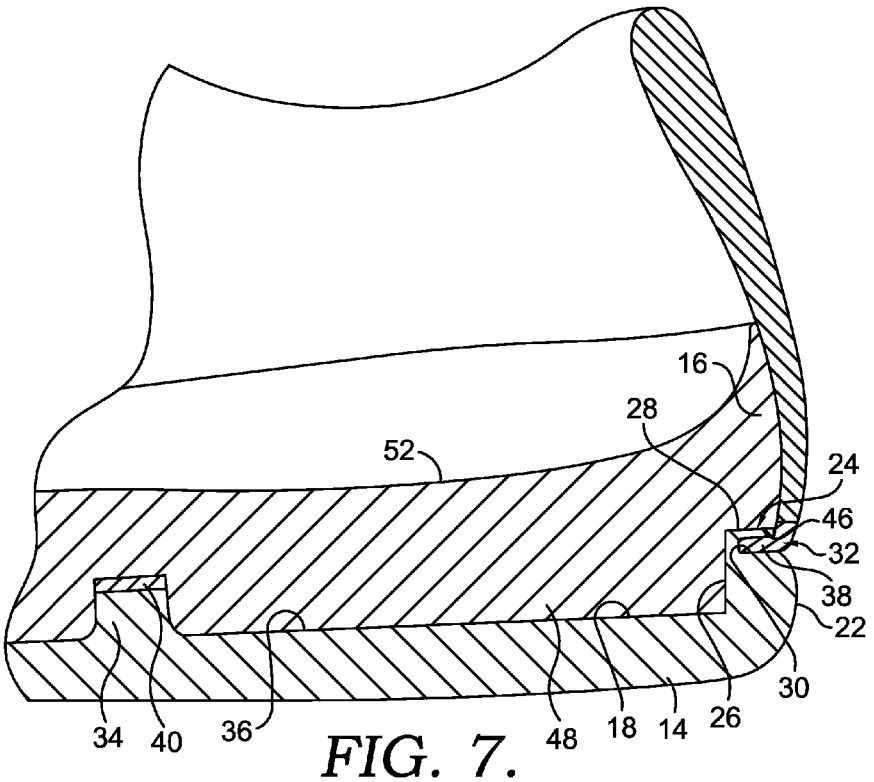
FIG. 7 is an enlarged, partial view of FIG. 6, showing the heel region enlarged to better reveal details of construction.

In aspects, the outsole 14 is a unitary piece. The outsole 14 includes an upper surface 18 and a lower surface 20, separated by a sidewall 22. The lower surface 20 may include any of the treads or features previously described for gripping the ground and/or creating traction. The lower surface 20 may further be divided into portions or regions, one corresponding to the ball of the foot and another corresponding to the heel of the foot, for example. As best seen in FIGS. 1 and 1A, the outsole 14 has a gasket 24 extending generally around the perimeter of the outsole 14, and is located slightly inwardly from sidewall 22, although gasket 24 could extend to the edge of sidewall 22 as well. As used hereinafter, "lip" and "outsole lip" may be used interchangeably, as needed for clarity. As best seen in FIG. 7, the gasket 24 is formed by an interior face 26 extending from upper surface 18. An extension 28 projects from face 26 towards sidewall 22. The extension 28 is spaced above a top, horizontal surface 30 of the sidewall 22 to form a channel 32, the importance of which is further described below.

As best seen in FIG. 1A, one or more portions of the gasket 24 are removed such that the gasket 24 is non-continuous along the perimeter of the outsole 14. In these locations, the top surface 30 of sidewall 22 forms the top of the outsole 14. The specifications and/or dimensions (e.g., width, length, depth, and/or shape) of the non-continuous gasket 24 may be based on the characteristics and/or materials used for the removable upper 12 and outsole 14. Alternatively, the gasket 24 can be formed continuously along the entire perimeter of the outsole 14.

As seen in FIG. 1A, the upper surface 18 of the outsole 14 includes one or more raised walls 34. In some aspects, raised walls 34 extend in a medial-lateral orientation to span the width of the outsole 14. The size, shape, placement, and/or number of raised walls 34 corresponds to the removed portions of the gasket 24, in aspects having a discontinuous gasket 24, for example. The raised walls 34 and the interior face 26 cooperate to define a number of pockets 36 on the upper surface 18. As shown in FIG. 1A, three pockets 36 are formed by two raised walls 34 and the interior face 26.

The upper 12 is shown separate from the outsole 14 and midsole 16 in FIG. 1. The upper 12 may comprise a large number of individual parts, often formed from different types of materials. The various components of the upper may be joined together using a variety of adhesives, stitches, and other types of joining/bonding components, for example. The exemplary upper 12 depicted in FIG. 1 may comprise any number of functional features such as, for example, any number of laces, eyelets, zippers, straps, hook-and-loop fasteners, draw strings, cord locks, hooks, elastics, and/or buckle elements (e.g., frame, tongue, and pin terminal).

The exemplary upper 12 depicted in FIG. 1 includes a perimeter rand 38. Perimeter rand 38 can be formed integrally with, or be coupled to, the remainder of the upper 12. The perimeter rand 38 is generally shaped to follow the perimeter, or contour, of the outsole gasket 24. In various aspects, the perimeter rand 38 is a continuous band or, alternatively, an interrupted band having regular or intermittent gaps. As shown in FIG. 1, the upper 12 also preferably includes one or more lateral bands 40 extending from the lateral to the medial side. The lateral bands 40 can be formed integrally with, or be attached to, the perimeter rand 38. As shown in FIG. 1, two lateral bands 40 may be used that are located correspondingly to raised walls 34. The perimeter rand 38 and lateral bands 40 form three open areas 42 that are shaped and located to correspond with pockets 36 on outsole 14.

Figure 2:
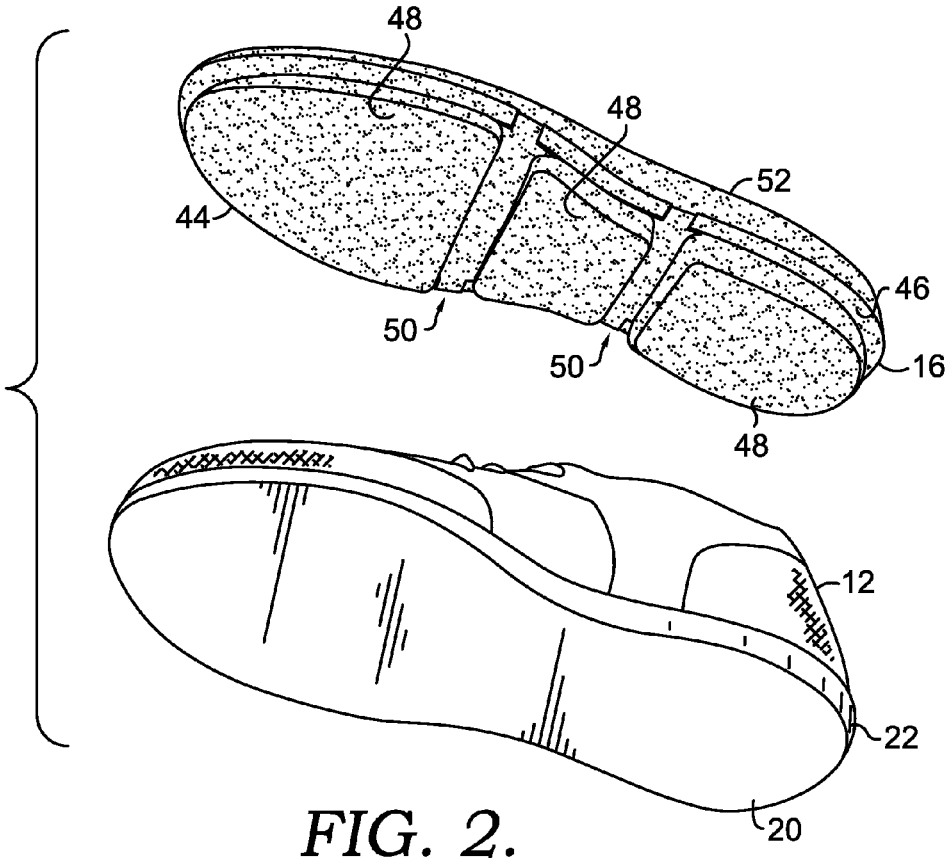
FIG. 2 is a view similar to FIG. 1, shown with the upper and outsole coupled together.
Figure 4:
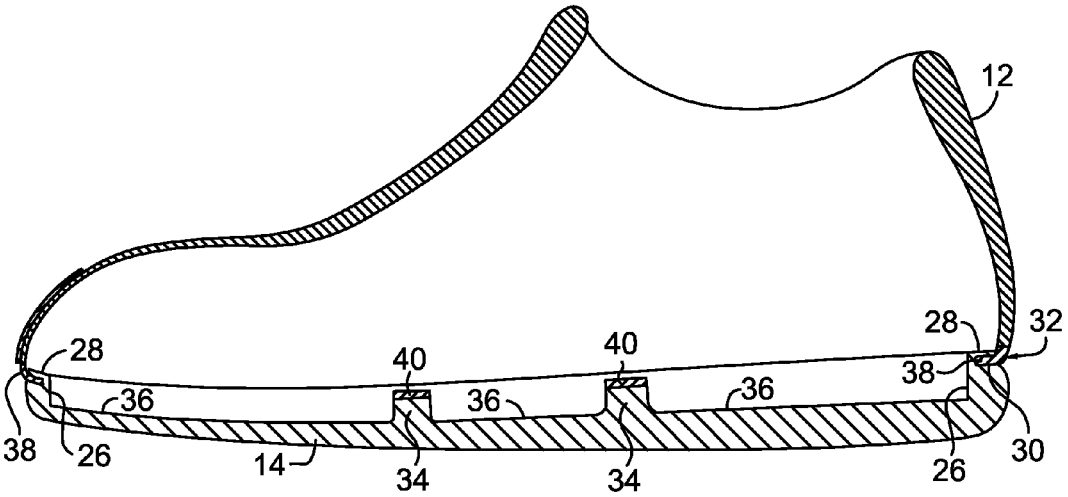
FIG. 4 is a cross-section of the assembled upper and outsole of FIG. 2, shown without the midsole.

Generally, the perimeter rand 38 is configured to slip into and/or snugly fit with the channel 32 of the outsole 14 such that the perimeter rand 38 is retained and held in place by the channel 32 without further aid, once inserted. The dimensions and/or configuration of the perimeter rand 38 and channel 32 are selected to allow insertion of the perimeter rand 38 within channel 32, and then to retain the fitment of the two components. For example, the perimeter rand 38 may be a particular shape, width, length, thickness, and/or rigidity in order to facilitate an insertion into channel 32, while promoting the retention of the perimeter rand 38 in the channel 32 once in place. FIG. 2 shows the upper 12 coupled to the outsole 14, with the perimeter rand 38 held within channel 32. The lateral bands 40 rest upon corresponding raised walls 34 as seen in the cross-section of FIG. 4, showing a cross-section of the upper 12 and outsole 14 coupled together.

Returning to FIGS. 1 and 2, the midsole 16 is shown prior to insertion in the shoe 10. The midsole 16 has a bottom surface 44 that includes a perimeter ledge area 46 that surrounds the perimeter of the midsole 16. The midsole 16 further has a number of attachment protrusions 48 extending downwardly away from the ledge 46. The protrusions 48 are separated by spaced slot areas 50. The protrusions 48 are shaped, sized, and positioned to mate with the pockets 36 in outsole 14. Similarly, the slot areas 50 are sized and positioned to mate with raised walls 34. Midsole 16 further has a top surface 52 configured for a user's foot. Generally, the upper surface 52 has a foot-contacting surface. In other aspects, a sock-liner is placed over the upper surface 52 of the midsole 16. The upper surface of the midsole 16 may have a specific and ergonomic foot-supporting topography generally corresponding to parts of a foot (e.g., toe, arch, and heel). Additionally, the upper surface of the midsole 16 may include a raised perimeter edge that slopes downward and inward to cradle and/or cup a person's foot and further facilitates positioning the person's foot for comfort and support during wear. Additionally and/or alternatively, the upper surface of the midsole 16 may be textured to create a friction and/or ergonomic grip of a foot. Any number of variations may be included to promote comfort and support of a wearer's foot and the durability and stability of the assembled footwear. The midsole 16 may be constructed of flexible, compressible, shock-absorbent, and/or deformable materials, and/or layers thereof, which provide comfort and support to the wearer. Examples of materials often used in midsoles are, for example, ethylene vinyl acetate foams, polyurethane foams, and the like. The midsole 16 and/or outsole 14 might include additional components, including cushioning components (such as springs, air bags, and the like), functional components (such as motion control elements to address pronation or supination), protective elements (such as resilient plates to prevent damage to the foot from hazards on the floor or ground), and the like. While these and other components that may be present in the upper, midsole, and/or outsole are not specifically described in examples herein, such components may be present in articles of footwear in accordance with aspects hereof.

Figure 3:
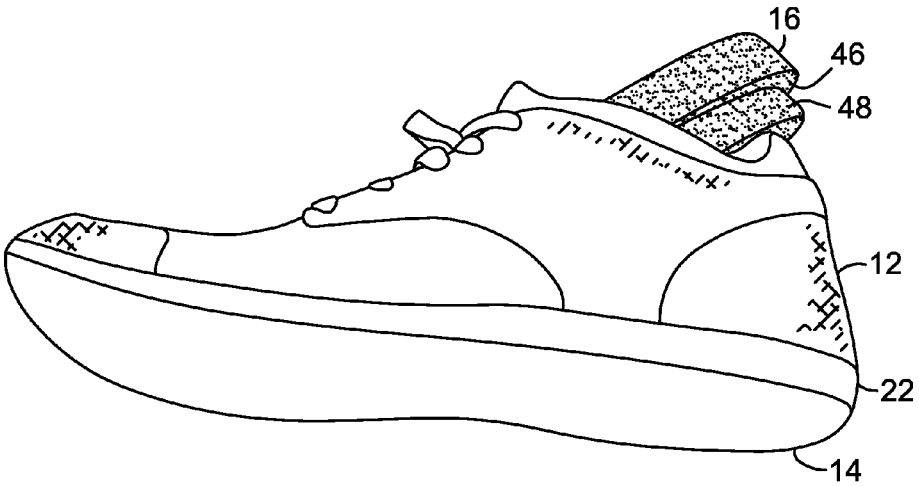
FIG. 3 is a view similar to FIG. 2, shown with the midsole partially inserted into the upper.
Figure 5:
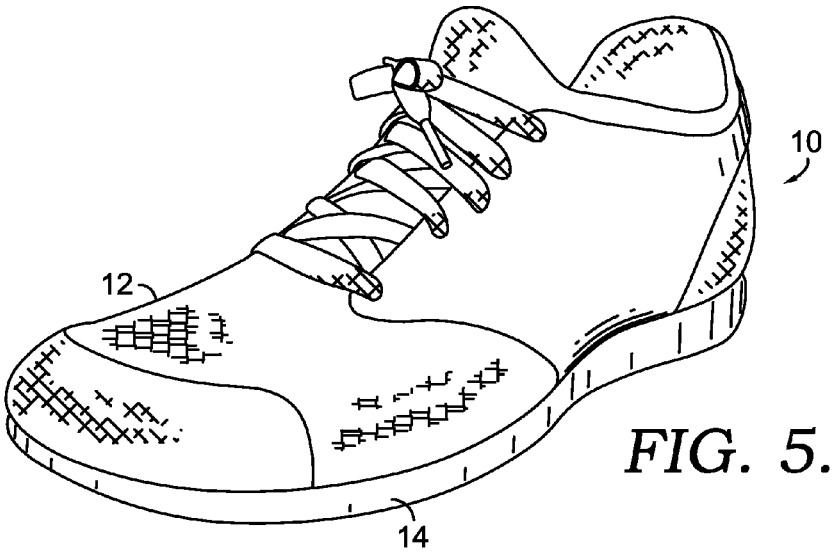
FIG. 5 is a lateral perspective view similar to FIG. 3, but with the midsole completely inserted into the upper.
Figure 6:
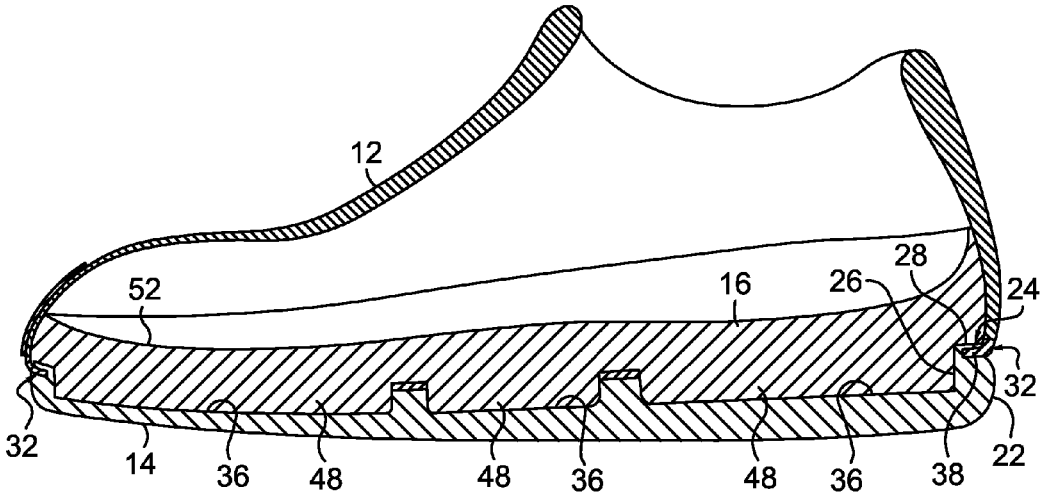
FIG. 6 is a cross-section of the assembled article of footwear of FIG. 5.

The midsole 16 is shown partially inserted into the coupled outsole 14 and upper 12 in FIG. 3. The shoe 10 showing the upper 12, outsole 14 and midsole 16 coupled together is shown in FIGS. 5-7. When inserted into the upper 12 and outsole 14 coupling, the midsole 16 further couples the components together. More specifically, the attachment protrusions 48 of the midsole 16 mate with the pockets 36 of the outsole 14. The slot areas 50 of the midsole 16 rest upon the lateral bands 40 of the upper 12, which in turn rest upon the raised walls 34 of the outsole 14. The lateral bands 40 are thus trapped between the midsole 16 and the outsole 14. The perimeter ledge 46 of the midsole 16 rests directly upon the top of extension 28 of the outsole 14, acting to compress channel 32 to further secure the perimeter rand 38 of the upper 12 within the channel 32 and operating to further secure the upper 12 to the outsole 14. In various aspects, the interior face 26 and the raised walls 34 may be striated, ribbed, and/or textured in a manner that promotes a friction 'grip' when contacted by a corresponding portion of the attachment protrusions 48 of the midsole 16. Similarly, attachment protrusions 48 may include ribs, edges, teeth and/or outward extensions, or, additionally or alternatively, may include inward recesses be configured to mate with ribs, edges, teeth and/or outward extensions belonging to the interior face 26 of the outsole gasket 24. Any outward extensions and/or inward recesses of attachment protrusions 48 are generally configured to contact and/or mate with the interior face 26.

The removable nature of the upper 12, outsole 14, and midsole 16 allows quick and easy changes and/or swaps of footwear components 12, 14, and 16 in order to customize the footwear 10 for a variety of purposes. For example, a person may change the upper 12, outsole 14, and midsole 16 of the footwear 10 for aesthetic reasons, such as color and/or other design reasons (e.g., team colors, uniform colors, and personal preference). As another example, a person may change the footwear components 12, 14, and 16 for performance reasons, such as replacing a worn outsole and/or adopting an outsole 14 designed for a particular surface (e.g., basketball court flooring or rock climbing) and/or purpose (e.g., cleats for soccer, spikes for track and field, or perforations for rowing foot plates).

In additional examples, a person may change the footwear components 12, 14, and 16 for comfort. A person may choose to insert a midsole having more or less arch support, shock absorption, and/or cushioning based on personal preference, for example. In another example, a person may choose a particular upper for any of the reasons described (e.g., aesthetics, performance, comfort, etc.). As such, a person may customize the article of footwear 10 with any number of combinations of various and different uppers, outsoles, and midsoles.

In further examples, a retailer may assist a customer in choosing an upper 12, outsole 14, and/or midsole 16 based on the aesthetics, performance, and/or comfort. In one example, a retailer may assemble the customized article of footwear 10 from the chosen upper 12, outsole 14, and/or midsole 16 to allow a customer to try on the custom combination. Additionally, the retailer may permanently couple the preferred upper 12, outsole 14, and midsole 16 to one another for the customer. Alternatively, the footwear components 12, 14, and 16 may not be permanently fixed to each other, allowing the customer to change and/or swap different uppers, outsoles, and midsoles in order to generate various combinations of customized footwear 10.

Figure 8:
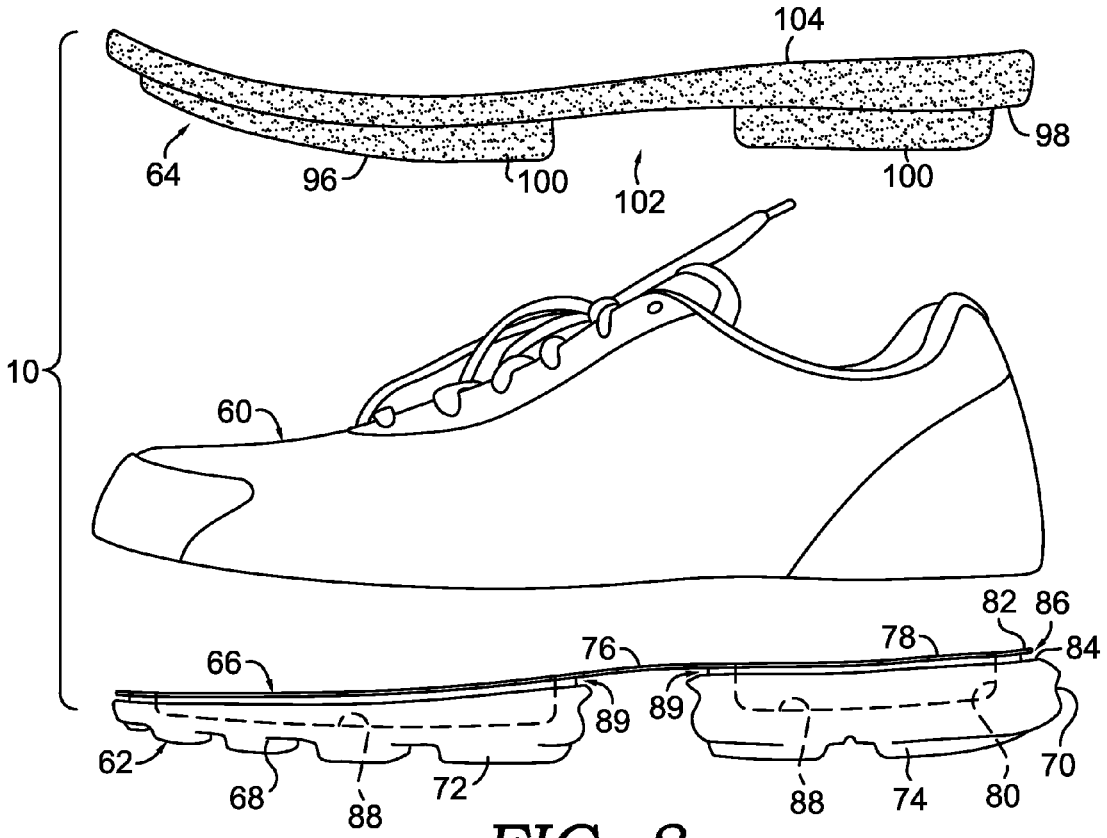
FIG. 8 depicts a lateral, exploded view of a second aspect of an exemplary article of footwear, shown with the upper, midsole, and outsole detached from one another.

FIGS. 8-11 depict an alternative illustrative aspect of the footwear 10. As best seen in FIG. 8, the footwear 10 includes an upper 60, outsole 62 and midsole 64 that are similar in many respects to the upper 12, outsole 14, and midsole 16 discussed above. However, certain details of construction are different in the footwear 10 of FIGS. 8-11.

Figure 11:
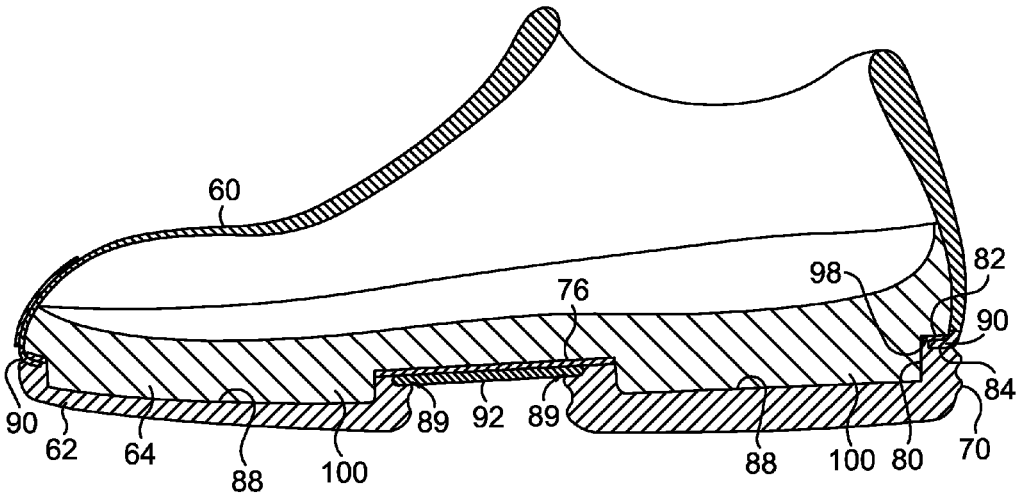
FIG. 11 is a cross-section of the assembled article of footwear of FIG. 10

The outsole 62 includes an upper surface 66 and a lower surface 68 that are spaced apart by a sidewall 70. The lower surface 68 of outsole 62 has two distinct contacting regions, one region 72 generally corresponding to forefoot area, and one region 74 generally corresponding to the heel area. Regions 72 and 74 are coupled by bridge 76 that extends from one side of outsole 62 to the other side. As best seen in FIG. 8, the outsole 62 has a gasket 78 extending generally around the perimeter of the outsole 62, and is located slightly inwardly from sidewall 70, although gasket 78 could extend to the edge of sidewall 70 as well. As used hereinafter, "lip" and "outsole lip" may be used interchangeably, as needed for clarity. The gasket 78 is formed by an interior face 80 extending from upper surface 66. An extension 82 projects from face 80 towards sidewall 70. The extension 82 is spaced above a top, horizontal surface 84 of the sidewall 70 to form a channel 86, the importance of which is further described below. In an exemplary aspect, the extension 82 transitions to the bridge 76 in a continuous plane. The bridge 76 and a portion of the top surface 84 act to form two inner channels 89, as best seen in FIGS. 8 and 11. Like outsole 14, the upper surface 66 of outsole 62 defines a number of pockets 88. As shown in FIGS. 8 and 11, two pockets 88 are formed in upper 62, one above region 72 and one above region 74.

Figure 8A:
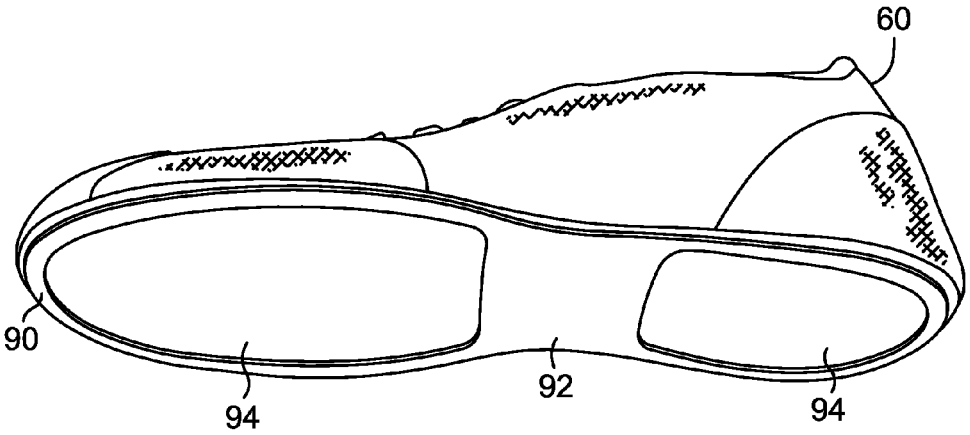
FIG. 8A is a bottom perspective view of the upper of FIG. 8.

The upper 60 is shown separate from the outsole 62 and midsole 64 in FIGS. 8 and 8A Like upper 12, the upper 60 may comprise a large number of individual parts, often formed from different types of materials. The various components of the upper may be joined together using a variety of adhesives, stitches, and other types of joining/bonding components, for example. The exemplary upper 60 depicted in FIG. 8 may comprise any number of functional features such as, for example, any number of laces, eyelets, zippers, straps, hook-and-loop fasteners, draw strings, cord locks, hooks, elastics, and/or buckle elements (e.g., frame, tongue, and pin terminal).

As best seen in FIG. 8A, the exemplary upper 60 includes a perimeter rand 90. Perimeter rand 90 can be formed integrally with, or be coupled to, the remainder of the upper 60. The perimeter rand 90 is generally shaped to follow the perimeter, or contour, of the outsole gasket 78. In various aspects, the perimeter rand 90 is a continuous band or, alternatively, an interrupted band having regular or intermittent gaps. As shown in FIG. 8A, the upper 60 also includes a lateral band 92 extending from the lateral to the medial side. The lateral band 92 can be formed integrally with, or be attached to, the perimeter rand 90. As shown in FIG. 11, lateral band 92 is located correspondingly to bridge 76 of outsole 62. The perimeter rand 90 and lateral band 92 form two open areas 94 that are shaped and located to correspond with pockets 88 on outsole 62.

Figure 9:
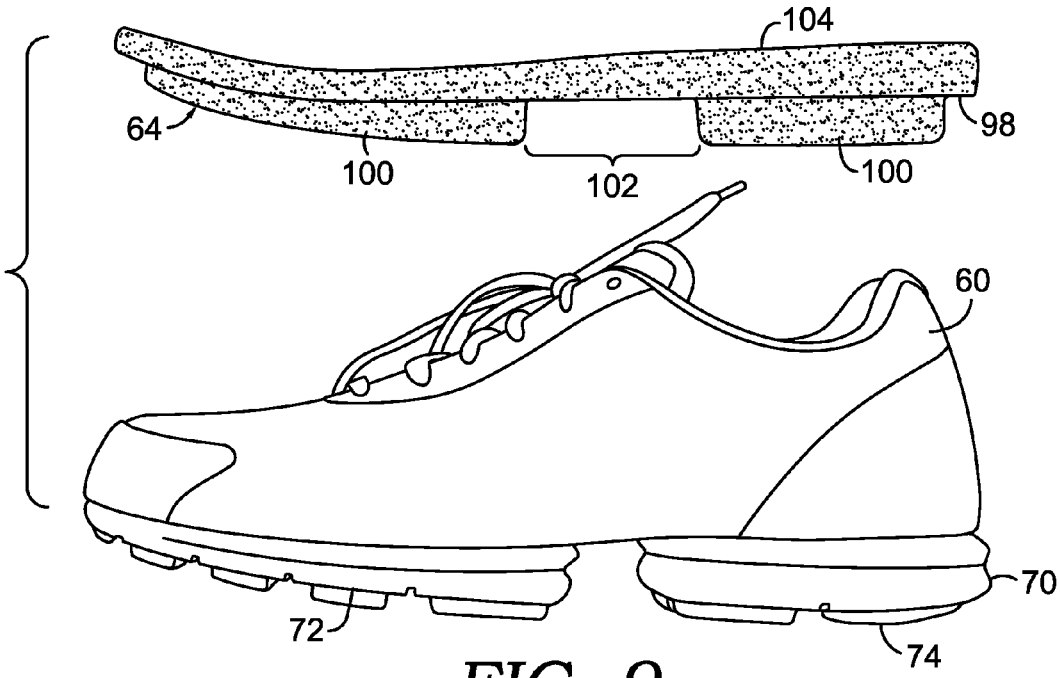
FIG. 9 is a view similar to FIG. 8, shown with the upper and outsole coupled together, before insertion of the midsole.
Figure 10:
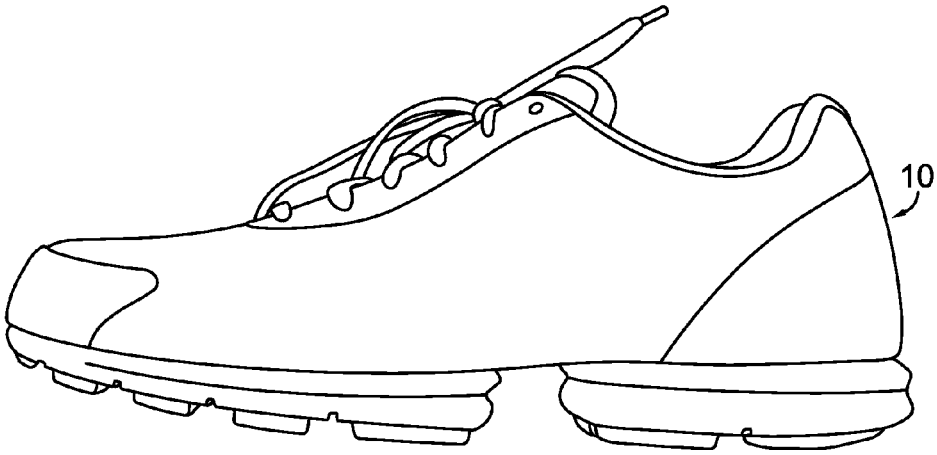
FIG. 10 is a view similar to FIG. 8, but showing the assembled article of footwear, with the midsole inserted into the upper.

Generally, the perimeter rand 90 is configured to slip into and/or snugly fit with the channel 86 of the outsole 62 such that the perimeter rand 90 is retained and held in place by the channel 86 without further aid once inserted. Similarly, the edges of lateral band 92 fit within the inner channels 89, as seen in FIG. 11. The dimensions and/or configuration of the perimeter rand 90 and channel 86, and lateral band 92 and channels 89, are selected to allow insertion of the perimeter rand 90 within channel 86, and the edges of lateral band 92 within channels 89, and then to retain the fitment of the two components. For example, the perimeter rand 90, and lateral band 92 may be a particular shape, width, length, thickness, and/or rigidity in order to facilitate insertion into channels 86 and 89, respectively. FIG. 9 shows the upper 60 coupled to the outsole 62, with the perimeter rand 90 held within channel 86 and the edges of lateral band 92 held within channels 89. To couple upper 60 to outsole 62, the outsole 62 is inserted through the upper 60 from the top. Forefoot region 72 is inserted through the forward open area 94 in upper 60, and heel region 74 is inserted through the rear open area 94. As best seen in FIG. 11, the lateral band 92, in this exemplary aspect, is located external to the footwear.

Returning to FIG. 8, the midsole 64 is shown prior to insertion in the shoe 10. Midsole 64 is constructed much the same as midsole 16 with a bottom surface 96 that includes a perimeter ledge area 98 that surrounds the perimeter of the midsole 64. The midsole 64 further has a number of attachment protrusions 100 extending downwardly away from the ledge 98. The protrusions 100 are separated by a spaced slot area 102. The protrusions 100 are shaped, sized and positioned to mate with the pockets 88 in outsole 62. As shown in this aspect, the midsole 64 includes two attachment protrusions 100. The two attachment protrusions 100 extend and/or pass through the two open areas 94 of the upper 60, and then into pockets 88 of outsole 62. Similarly, the slot area 102 is sized and positioned to extend over bridge 76 of outsole 62. Midsole 64 further has a top surface 104 configured for a user's foot as described above with respect to midsole 16.

After the upper 60 and outsole 62 are coupled together, as described above, the midsole 64 is inserted into the upper 60. As best seen in FIG. 11, the two attachment protrusions 100 pass through the open areas 94 of the upper 60, and then into pockets 88 of outsole 62. The slot area 102 extends over bridge 76 of outsole 62. The perimeter ledge 98 rests upon the extension 82 of gasket 78, and operates to hold the perimeter rand 90 within channel 86 by slightly compressing the channel 86 as a user wears the footwear.

The uses and advantages discussed above with respect to FIGS. 1-7 apply equally to FIGS. 8-11 and will not be repeated here.

Figure 12:
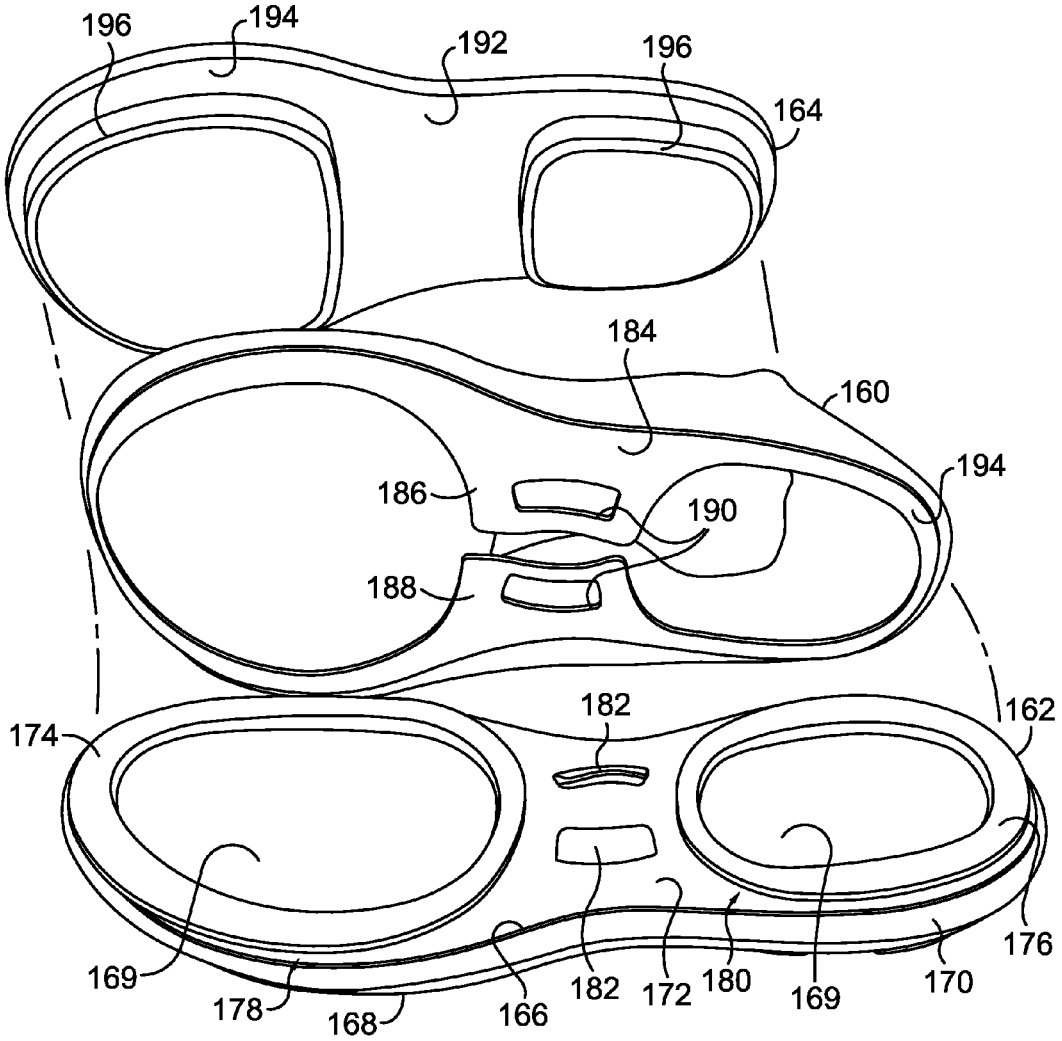
FIG. 12 is a perspective, exploded view of another aspect of an exemplary article of footwear, shown with the upper, midsole, and outsole detached from one another.

FIG. 12 depicts an alternative illustrative aspect of the footwear 10. As with previously described aspects, the footwear 10 in this aspect includes an upper 160, and outsole 162 and a midsole 164 that are similar in many respects to the previously described uppers, outsoles and midsoles. However, certain details of construction are different in the footwear 10 of FIG. 12.

The outsole 162 includes an upper surface 166 and a lower surface 168 that are spaced apart by a sidewall 170. The upper surface 166 has a pair of pockets 169 formed therein. The outsole 162 further includes a gasket 172 that can be integrally formed with outsole 162, or can be coupled to the outsole. The gasket 172 includes a forefoot gasket extension 174 and a heel gasket extension 176. Extensions 174, 176 are spaced above the upper surface 166 extending generally around the pockets 169 and form a pair of ovular channels labeled 178 and 180. The area of gasket 172 between extensions 174 and 176 includes a pair of protrusions 182. Protrusions 182 extend upwardly from the surface of gasket 172 and are inclined such that they extend at an incline from the outer area to the inner area. This incline forms a cam, or ramp, which is used to secure the upper 160 to the outsole 162.

The upper 160 is shown from a bottom perspective view in FIG. 12. The upper 160 may be constructed similarly to the previously described uppers. The main difference between upper 160, and the previously described upper 60, is that the lateral band 184 of upper 160 is split lengthwise forming a lateral tab 186 and a medial tab 188. In addition, the tabs 186, 188 each have a retention slot 190 formed therein. Retention slots 190 are preferably shaped and sized to correspond to the shape and size of protrusions 182. The remainder of a perimeter rand 194 is shaped to correspond to the forefoot extension 174 and the heel extension 176.

The perimeter rand 194 of upper 160 is configured to slip into and/or snugly fit within the ovular channels 178 and 180. As the rand 194 is moved into place within channels 178, 180, the tabs 186, 188 are moved into contact with the protrusions 182. The incline of the protrusions 182 cams the tabs 186, 188 upwardly, until the retention slots 190 snap into place around the protrusions 182. Thereafter, the interaction of the retention slots 190 and the protrusions 182 aid in securing the upper 160 to the outsole 162.

The midsole 164 is similar in construction and use to midsole 64 and is shown in FIG. 12 prior to insertion in the shoe 10. Midsole 164 is constructed with a bottom surface 192 that includes a perimeter ledge area 194 that surrounds the perimeter of the midsole 164. The midsole 164 further has a number of attachment protrusions 196 extending downwardly away from the ledge 194. The protrusions 196 are shaped, sized and positioned to mate with the pockets 169 in outsole 162. Midsole 164 further has a top surface configured for a user's foot as described above with respect to midsoles 16 and 64. In use, midsole 164 is inserted into upper 160 after upper 160 is coupled with outsole 162, further coupling the components to one another as protrusions 196 of midsole 164 nest within pockets 169 of outsole 162.

Figure 13:
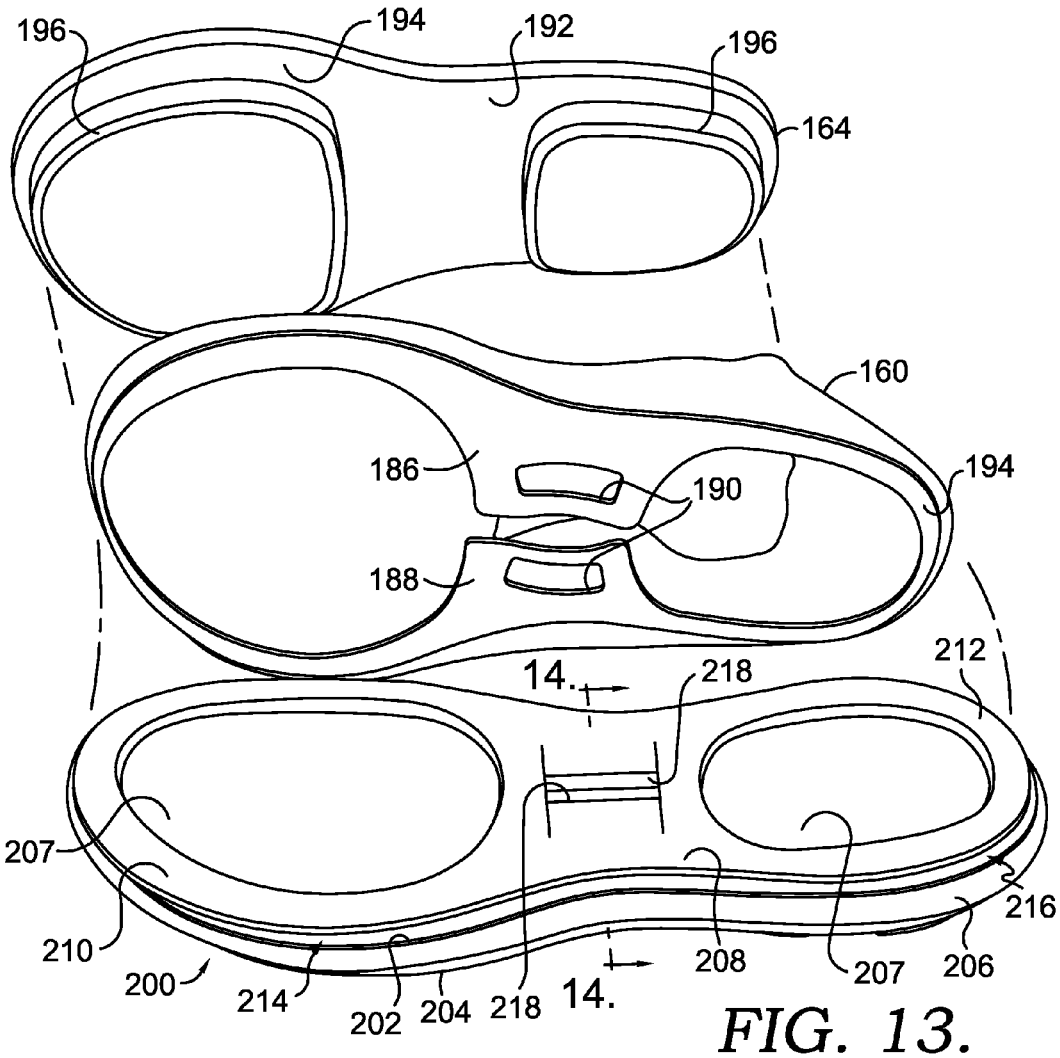
FIG. 13 is a perspective, exploded view of another aspect of an exemplary article of footwear, shown with the upper, midsole, and outsole detached from one another.
Figure 14:
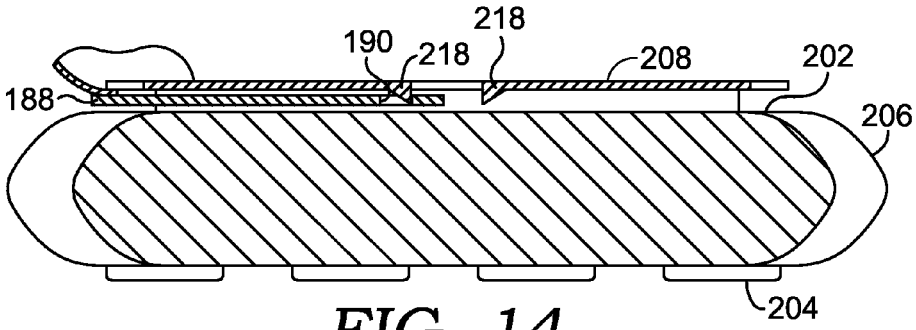
FIG. 14 is a partial cross-section taken along line 14-14 of FIG. 13.

FIGS. 13 and 14 depict another alternative illustrative aspect of the footwear 10, with only slight variations from that of FIG. 12. As with previously described aspects, the footwear 10 in this aspect includes an upper 160 and midsole 164 that are of the same construction as that described above with respect to FIG. 12. However, a different outsole/gasket construction is used in this illustrative aspect.

The outsole 200 shown in FIG. 13 includes an upper surface 202 and a lower surface 204 that are spaced apart by a sidewall 206. The upper surface 202 has a pair of pockets 207 formed therein. The outsole 200 further includes a gasket 208 that can be integrally formed with outsole 200, or can be coupled to the outsole. The gasket 208 includes a forefoot gasket extension 210 and a heel gasket extension 212. Extensions 210, 212 are spaced above the upper surface 202 to form a pair of ovular channels labeled 214 and 216. The area of gasket 208 between extensions 210 and 212 includes a pair of protrusions 218. Protrusions 218 extend downwardly from the top surface of gasket 208 and are inclined as shown in FIG. 14. This incline forms a cam, or ramp, which is used to secure the upper 160 to the outsole 200.

The perimeter rand 194 of upper 160 is configured to slip into and/or snugly fit within the ovular channels 214, 216. As the rand 194 is moved into place within channels 214, 216, the tabs 186, 188 are moved into contact with the protrusions 218. The incline of the protrusions 218 cams the tabs 186, 188 downwardly, until the retention slots 190 snap into place around the protrusions 218. Thereafter, the interaction of the retention slots 190 and the protrusions 218 aid in securing the upper 160 to the outsole 200. The main difference between the exemplary aspect shown in FIG. 12 and that of FIGS. 13 and 14 is the gasket 208 is inverted as compared with gasket 176. The rand 194 thus fits under the gasket 208 in the area of protrusions 218.

The midsole 164 in use, is inserted into upper 160 after upper 160 is coupled with outsole 200, further coupling the components to one another as protrusions 196 of midsole 164 nest within pockets 207 of outsole 200.

Figure 15:
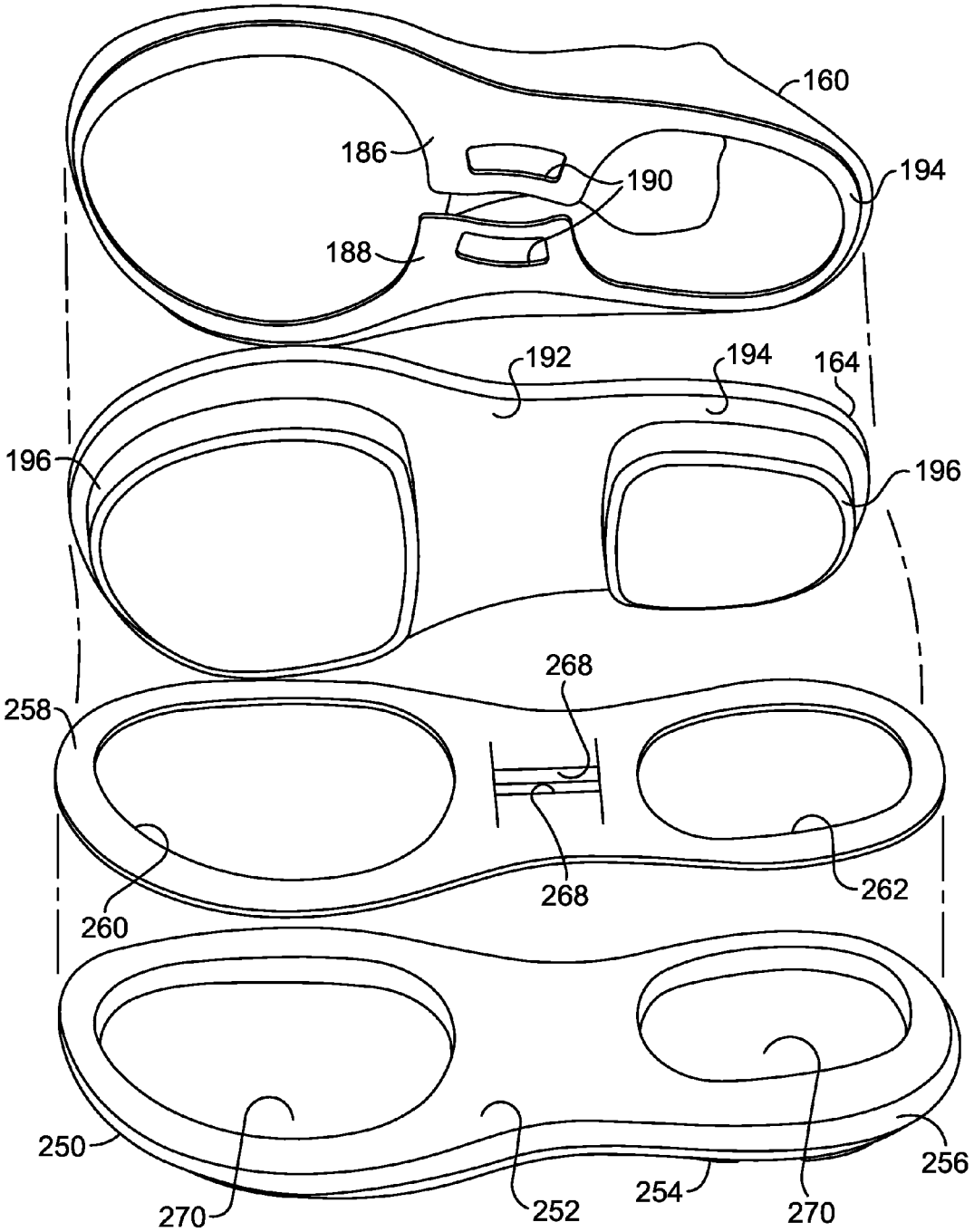
FIG. 15 is a perspective, exploded view of another aspect of an exemplary article of footwear, shown with the upper, midsole, plate and outsole detached from one another.
Figure 16:
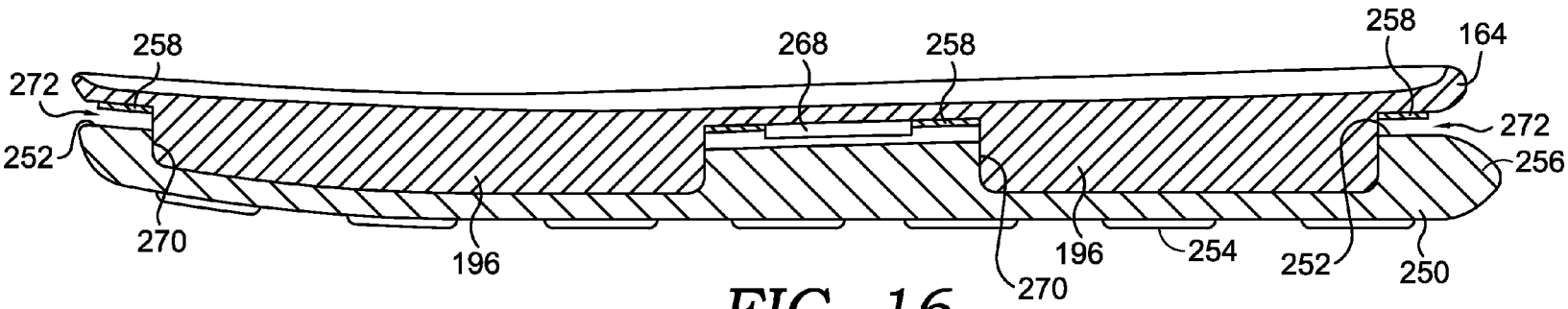
FIG. 16 is a cross-section showing the outsole, plate and midsole of FIG. 15 coupled together.

FIGS. 15 and 16 depict another alternative illustrative aspect of the footwear 10, with minor variations from those of FIG. 12, and FIGS. 13-14. As with previously described aspects, the footwear 10 in this aspect includes an upper 160 and midsole 164 that are of the same construction as that described above with respect to FIG. 12. However, a different outsole/gasket construction is used in this illustrative aspect.

The outsole 250 shown in FIGS. 15 and 16 includes an upper surface 252 and a lower surface 254 that are spaced apart by a sidewall 256. The upper surface 252 has a pair of pockets 270 formed therein. In this exemplary aspect a plate 258 is provided. The plate 258 is preferably more rigid than the previously described gaskets, such as gasket 208. The plate 258 includes a forefoot opening 260 and a heel opening 262. The area of plate 258 between openings 260 and 262 includes a pair of protrusions 268. Protrusions 268 extend downwardly from the top surface of plate 258 and are inclined similarly to protrusions 218 of FIG. 14. This incline forms a cam, or ramp, which is used to secure the upper 160 to the outsole 250. The plate 258 is coupled to the lower surface of midsole 164, such as by an adhesive. The coupled midsole 164 and plate 258 are then coupled to the outsole 250, with protrusions 196 of midsole 164 nesting within pockets 270 of outsole 250. The protrusions 196 extend further away from the lower surface of midsole 164 than the depth of pockets 270, forming a channel 272 between the bottom of plate 258 and the upper surface 252 of upper outsole 250.

The perimeter rand 194 of upper 160 is configured to slip into and/or snugly fit within the channel 272. As the rand 194 is moved into place within channel 270, the tabs 186, 188 are moved into contact with the protrusions 268. The incline of the protrusions 268 cams the tabs 186, 188 downwardly, until the retention slots 190 snap into place around the protrusions 268. Thereafter, the interaction of the retention slots 190 and the protrusions 268 aid in securing the upper 160 to the outsole 250. The main difference between the exemplary aspect shown in FIG. 12 and FIGS. 13 and 14, and that of FIGS. 15 and 16 is the plate 258 is coupled to midsole 164 and the midsole 164, plate 258 and outsole 250 are coupled together prior to coupling the upper 160 to the shoe 10.

From the foregoing, it will be seen that this disclosure is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made without departing from the scope thereof, it is to be understood that all matter herein set forth or shown in the accompanying drawings is to be interpreted as illustrative and not in a limiting sense.

The invention claimed is:

1. An article of footwear, comprising:

an outsole having:

a lower surface, an upper surface having a pair of spaced apart raised walls, and a gasket extending upward from the upper surface and forming a perimeter of the upper surface, the gasket having an outwardly protruding extension forming a channel;

an upper having an open area defined by a lower edge, the lower edge having an inwardly extending perimeter rand, the perimeter rand shaped and positioned to mate with the channel, the upper having a pair of lateral bands that extend across the open area of the upper from a medial side of the upper to a lateral side of the upper; and a midsole configured to be received within the upper and having an upper surface and a lower surface, the lower surface having at least a ledge extending generally about the perimeter of the midsole, the ledge resting upon the protruding extension of the gasket on the outsole;

wherein the perimeter rand of the upper is configured to mate with the channel of the outsole to couple the upper to the outsole, wherein the midsole is configured to be received within the upper, and wherein the pair of lateral bands of the upper are configured to rest between the pair of spaced apart raised walls of the outsole and the lower surface of the midsole to further form the article of footwear.

2. The article of claim 1, wherein the upper surface of the outsole defines a plurality of pockets, and wherein the lower surface of the midsole has a corresponding plurality of attachment protrusions sized and shaped to mate with the pockets in the outsole.

3. The article of claim 2, wherein three pockets are defined in the outsole and are separated by the pair of spaced apart, raised walls.

4. The article of claim 3, wherein the open area of the upper is separated into three open areas by the pair of lateral bands that extend across the open areas of the upper from a medial side of the upper to a lateral side of the upper.

5. The article of claim 4, wherein the attachment protrusions of the midsole are separated by slot areas sized and positioned to mate with the raised walls when the midsole is positioned inside the upper and in contacting relationship with the outsole.

6. The article of claim 5, wherein the perimeter rand includes a reinforcing material.

7. The article of claim 6, wherein the outward protruding extension of the gasket is discontinuous about the perimeter, wherein the gasket has open areas along portions of the perimeter.

8. The article of claim 7, wherein the attachment protrusions of the midsole have an outer contacting surface configured to mate with a corresponding surface of the pockets in the outsole.

* * * * *